United States Patent [19]

Van Patten

[11] Patent Number: 4,493,391

[45] Date of Patent: Jan. 15, 1985

[54] SAFETY LOWERING DEVICE

[76] Inventor: Preston J. Van Patten, 15 Lynn Dr., Scotia, N.Y. 12302

[21] Appl. No.: 383,966

[22] Filed: Jun. 1, 1982

[51] Int. Cl.[3] ..... A62B 1/16

[52] U.S. Cl. ..... 182/6; 182/7; 188/65.2

[58] Field of Search ..... 188/65.1, 65.2, 65.3, 188/65.4, 65.5; 182/3, 5, 4, 6, 7, 9, 10, 11

[56] References Cited

U.S. PATENT DOCUMENTS

| | | | |
|---|---|---|---|
| 316,870 | 4/1889 | Brawnfeld | 188/65.4 |
| 785,019 | 3/1905 | Parker | 188/65.4 |
| 1,149,394 | 8/1915 | Morrissey | 188/65.3 |
| 1,351,734 | 9/1920 | Barrington | 182/5 |
| 1,631,279 | 6/1927 | Mandy | 182/5 |
| 1,746,742 | 2/1930 | Roberts | 182/6 |
| 4,372,422 | 2/1983 | Sharp | 188/65.4 |

FOREIGN PATENT DOCUMENTS

| | | | |
|---|---|---|---|
| 501196 | 4/1954 | Canada | 182/190 |
| 75405 | 7/1893 | Fed. Rep. of Germany | 182/3 |
| 107303 | 10/1924 | Switzerland | 182/3 |
| 1347677 | 2/1974 | United Kingdom | 182/5 |
| 2090132 | 7/1982 | United Kingdom | 182/3 |

*Primary Examiner*—Reinaldo P. Machado
*Assistant Examiner*—A. Chin-Shue

[57] ABSTRACT

A self-contained safety device for self-lowering a person comprises an elongated high-strength safety webbing to support a person and a reel for releasably housing said webbing. The device comprises a generally figure 8 shaped member having two aligned apertures, a seat comprising a non-slip buckle means and two elongated seat webbings to form a big hole and one-half of waste hole. A friction knot is formed by passing the safety webbing through one aperture of the figure 8 member, said friction knot being manipulatable to extend the webbing at a controlled rate, and means at the free end of the safety webbing for anchoring the webb during lowering of the person.

6 Claims, 5 Drawing Figures

SAFETY LOWERING DEVICE

FIELD OF INVENTION

This invention relates to a lowering device, specifically one for moving a person or object from one height to a lower one.

DISCUSSION OF PRIOR ART

Heretofore, lowering devices used in prior applications for getting people out of high-rise buildings, specifically down the outside of the building. These lowering devices were restricted to one or more locations that could not readily be moved. Lowering methods by these devices were restricted to short distances due to the bulky equipment required.

All of these devices used took too much space and were an eyesore to the building.

OBJECTS

Accordingly, several advantages of my invention are: lower cost, reduced weight, reduced size, additional safety, and greater speed of use.

The cost of this invention is relatively inexpensive compared to prior art or other methods used to escape from high-rise buildings.

The weight of the preferred embodiment of my invention is just 6 pounds and I know of nothing on the market that will accomplish equivalent results for this weight.

The size of the preferred embodiment is 15 inches in diameter and 2 inches thick. It will extend down the side of a building 300 feet, or 30 stories (assuming the building has 10 foot stories). A larger unit could be made for use in higher buildings, but would, of course, be of a larger size.

My invention is strong enough to support any overweight person safely. The adjustable supporting seat is of the cinching type that one cannot fall out of if properly installed.

Its speed of use is controlled by the user. One can get out of a building to the ground quicker than any method used today including stairs, elavator, or fire escapes. Its use is thus invaluable.

Further objects and advantages of my invention will become apparent from a consideration of the drawings and ensuing description thereof.

DESCRIPTION

Figure 1:
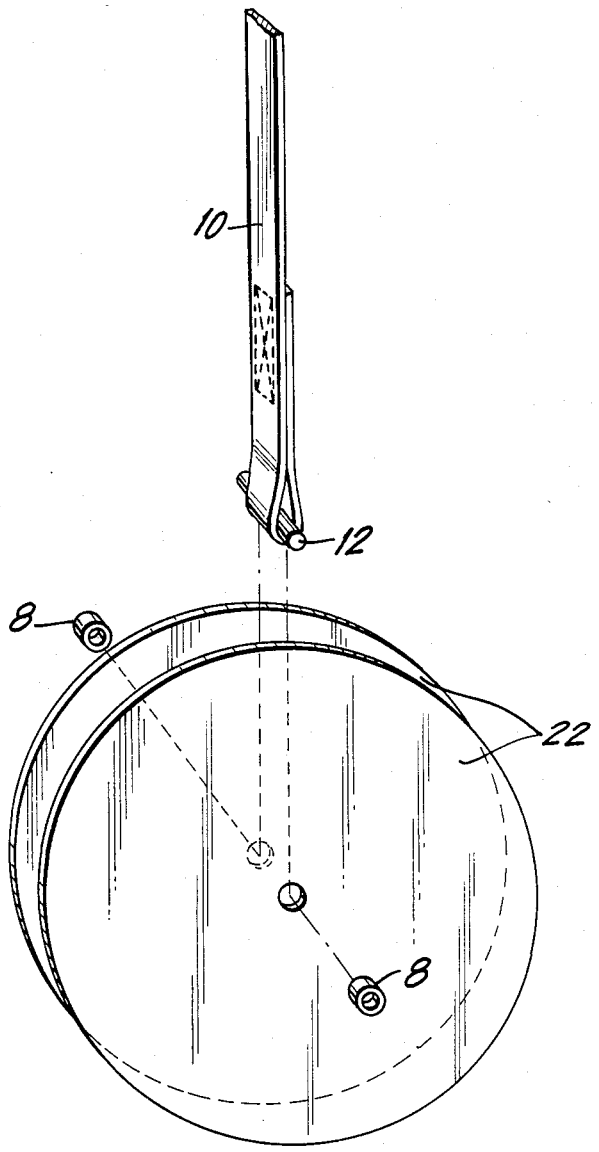
FIG. 1 is a perspective view of a life line reel.

My invention comprises (FIG. 1) a reel 22 of nylon webbing used as a life line. The reel consists of two 14½ inch circular pieces of 0.080" windo-type plastic with a ⅜ inch hole drilled in the centers. At the center of the reel, a 2 inch piece of ⅜ inch aluminum rod 12 is inserted. The plastic sides of the reel are held on to the aluminum rod by two pieces of plastic tubing 8, each measuring ¼ inch I.D. by ⅜ inch long and 3/16 inch wall thickness, preferable made of polyethylene plastic tubing. They are force fit over ends of the aluminum rod. A reel of one-inch nylon webbing, Mil-W-17337D is wound around the reel.

Life line 10 is of nylon webbing attached to the reel's center rod 12 by folding over and sewing a 6 inch seam. The aluminum rod has a 1/16 inch hole drilled in it and nylon thread is sewed through the hole into the nylon line to prevent the rod from falling out. The line is then wound onto the reel 22.

The other end of the line 10 has a 12 inch lap with 6 inches of it sewed and attached to a carabiner 14 (FIG. 2) such as a "Chouinard Light D" manufactured by Great Pacific Iron Works, P.O. Box 150, Ventura, Calif. 93002.

Figure 2:
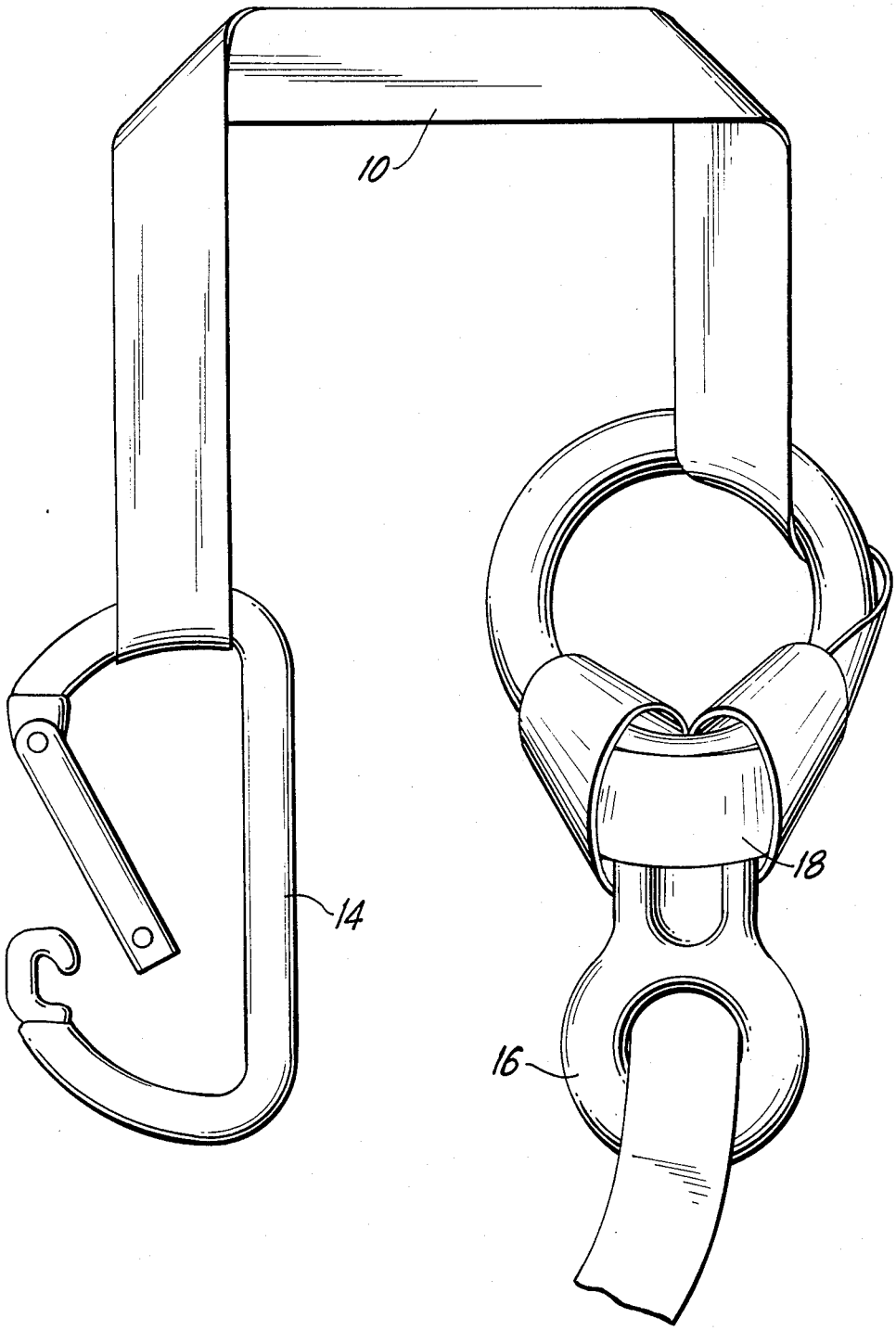
FIG. 2 is a perspective of a Figure "8" ring, friction knot, and carabiner used in the invention.

Spaced back from the carabiner 14 and of the line 10 by about 25 inches is a figure "8" ring 16 and friction knot 18 as shown in FIG. 2. Ring 16 is manufactured by Colorado Mountain Industries Corporation, P.O. Box 535, Franklin, W.Va. 26807.

Figure 3:
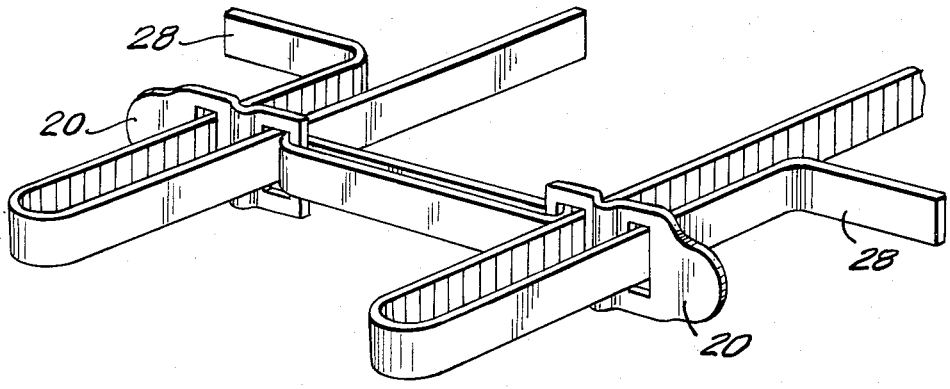
FIG. 3 is a perspective view of a supporting seat used in the invention.
Figure 3A:
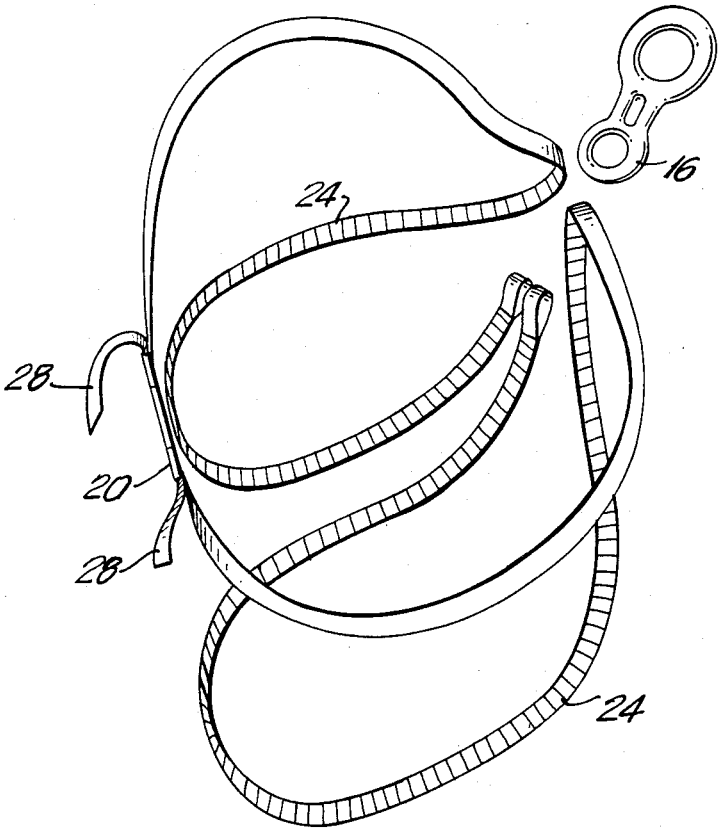
FIG. 3A is a perspective view of the harness and buckles assembly of this invention.

Referring to (FIG. 3), attached to the small circle of the ring 16 is an adjustable supporting seat 24 made of one-inch nylon webbing.

The adjusters on supporting seat 24 are non-slip buckles 20 preferable Model BN-2222, manufactured by EON Corporation, 2425 San Fernando Road, Los Angles, Calif. 90065. The lap over seams on the supporting seat attachment to ring 16 are 6 inches long with 3 inch seam sewed thereon. The lap over seam between the non-slip buckles 20 also have 3-inch sewed seams.

OPERATION

The operating parts of my invention are reel 22, life line 10, carabiner 14, figure "8" ring 16, supporting seat 24, and non-slip buckles 20.

The real serves two purposes: (1) it is used for compact line storage, and (2) the center of the reel on which the line is wound serves as a safety stop at the end of the line.

The line, when unrolled down the side of a building, provides a means for a person to travel down that line to the ground at a safe speed.

Carabiner 14 is a fastening device which will quickly fasten the line to a supporting structure.

Figure "8" ring 16 is used to regulate one's descent down the life line 10 and is the supporting structure for the supporting seat 24.

The supporting seat with adjusting non-slip buckles 20 is used to support a person or object.

Figure 4:
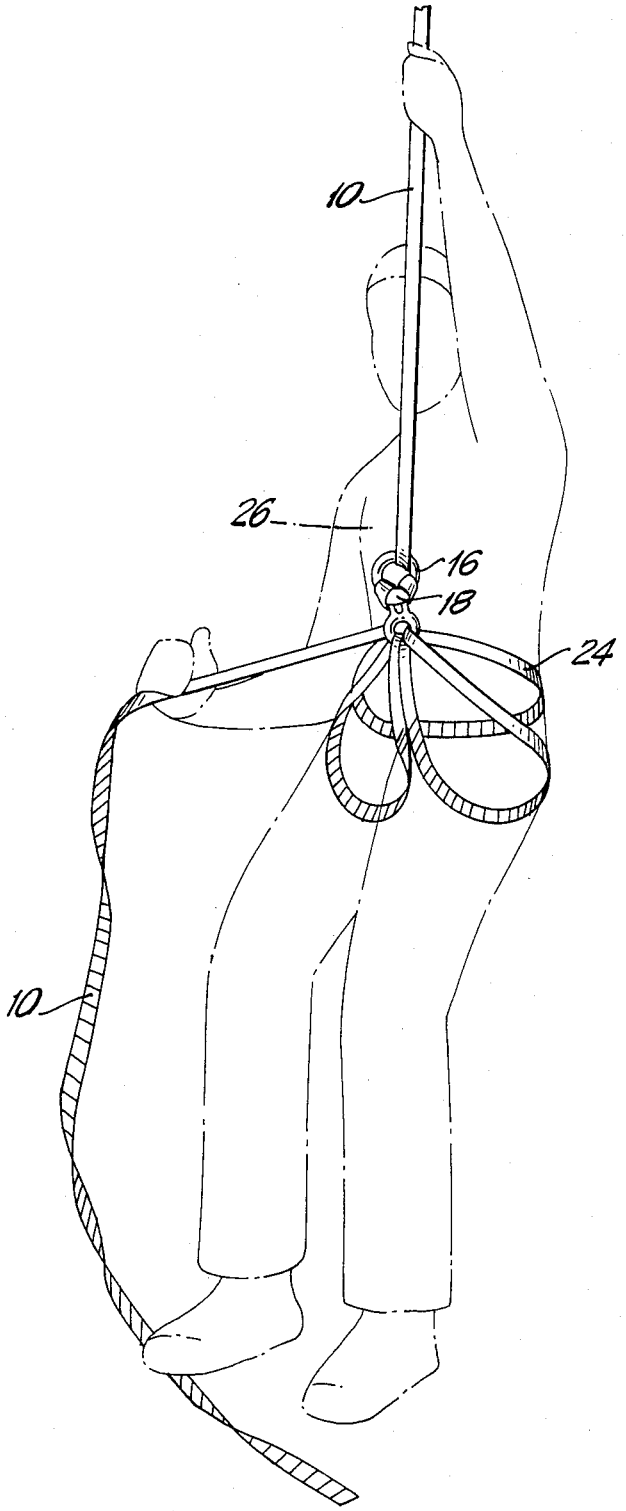
FIG. 4 illustrates my invention in operation.

Assume that a person 26 is in a high-rise hotel and a fire occures and person has no regular means of escape via stairs or elevator. As shown in (FIG. 4) the person would then open a window and look down to see that there is no fire below. The person would then follow the following instructions: (1) Open up the Safety Lowering Device. (2) Lay out supporting seat 24 on floor and stand in it as marked. (3) Pull it up to hip level, then pull up on waist band with non-slip buckles 20 to waist and pull on waist lines 28, adjusting to fit snugly. (4) Pull on line 10 with carabiner 14 and until you have enough line to wrap around a bed and hook back on line with carabiner. (5) Push bed over to wall where window is located. (6) Throw reel 22 out the window so it can unreel to ground. (7) Place a pillow on window sill where line 10 goes over. Climb out window with line tight to bed. (8) Regulate your descent down line with light pressure on line where it enters ring 16.

The Safety Lowering Device is packaged in heavy clear plastic with picture diagrams of operation in plain view.

While the above description contains many specificites, these should not be construed as limitations on the scope of the invention, but rather as an exemplification of one preferred embodiment thereof. Many other variations are possible, for example, this Safety Lowering Device may be used for lowering objects of any size within weight restrictions to the ground. Descent is regulated by operator on ground at the other end of the line.

Mountain climbers, fireman, steelworkers, construction workers, or anyone wanting to lower themselves or an object from one height to a lower height can use this device.

This Safety Lowering Device can be used horizonally to keep objects spaced apart by the use of light presure from an operator.

Accordingly, the scope of this invention should be determined not by the embodiment illustrated, but by the apended claims and their legal equivalents.

I claim:

1. A self-contained safety device for self-lowering a person, comprising (a) an elongated high-strength safety webbing of sufficient strength to safely support the person;

(b) a reel housing said webbing which is adapted to be released from said reel;

(c) a generally figure 8 shaped member having first and second adjacent aligned apertures in a common plane;

(d) a seat for secure engagement of said person, said seat comprising a non-slip buckle means and two elongated high-strength seat webbings each of said seat webbings being looped to form first a leg hole and one-half of waist hole, one-end of each seat webbing being secured by passing through said second aperture of said generally figure 8 shaped member, with a intermediate portion thereof, being folded back upon itself forming said leg hole and one-half of said waist hole, and the opposite end of each seat webbing being connected through said non-slip buckle means;

(e) a friction knot formed by passing said safety webbing through said second aperture and then through said first aperture of said generally figure 8 shaped member and about the wall of said first aperture, said friction knot being formed from said safety webbing and being manipulatable to extend said webbing at a controlled rate, and (f) means at the free end of said safety webbing for anchoring said safety webbing when the person is being lowered.

2. The device of claim 1 wherein said webbing is made of a flat piece of nylon webbing.

3. The device of claim 1 wherein said anchoring means is a carabiner.

4. The device of claim 1 further including a safety stop which prevents said person from coming off said webbing when reaching the end thereof.

5. The device of claim 1 wherein said webbing is fed through said generally figure 8 shaped member about said apertures thereby guiding said webbing.

6. A safety devive as in claim 1 wherein said non-slip buckle means comprises two non-slip buckles joined together by webbing with each of said seat webbing extending through one of said non-slip buckles.

* * * * *